US005718053A

United States Patent [19]

Strow et al.

[11] Patent Number: 5,718,053

[45] Date of Patent: Feb. 17, 1998

[54] STATIONARY PERSPECTIVE DEVICE

[76] Inventors: Donna Marie Strow, 634 Dunkirk Rd., Towson, Md. 21285; James Michael Gibbons, 309 Monterey Ave., Annapolis, Md. 21401

[21] Appl. No.: 550,978

[22] Filed: Oct. 31, 1995

[51] Int. Cl.[6] ..... B44D 2/00; B43L 13/16; B43L 13/00

[52] U.S. Cl. ..... 33/1 K; 33/20.3; 33/432

[58] Field of Search ..... 33/1 K, 16, 20.1, 33/20.3, 432, 286

[56] References Cited

U.S. PATENT DOCUMENTS

| | | | |
|---|---|---|---|
| 1,166,445 | 1/1916 | Cuvelier | 33/20.3 |
| 4,168,573 | 9/1979 | Chase | 33/1 K |
| 4,498,238 | 2/1985 | Vaughn | 33/1 K |

FOREIGN PATENT DOCUMENTS

| | | | |
|---|---|---|---|
| 890020 | 1/1944 | France | 33/20.3 |

*Primary Examiner*—Christopher W. Fulton
*Attorney, Agent, or Firm*—Royal W. Craig

[57] ABSTRACT

An artist's drawing device for maintaining a constant three-dimensional perspective while rendering a subject or object. The drawing device includes a first visually-defined perimeter of a planar geometric figure having a first size, a second visually-defined perimeter of a planar geometric figure having proportionate dimensions but a larger overall size than the first planar figure, and means for seeing the first and second planar geometric perimeters in a concentric spaced relation along the artist's line of sight, the smaller geometric perimeter being closer to the artist. The artist secures the device in position for viewing a subject or object therethrough such that the perimeter of the second geometric figure is eclipsed from sight by the perimeter of the first geometric figure. This fixes the artist's perspective on said subject/object in all of three dimensions, and any deviation from said fixed perspective becomes immediately apparent when the state of eclipse is lost.

14 Claims, 6 Drawing Sheets

STATIONARY PERSPECTIVE DEVICE

CROSS-REFERENCE TO RELATED APPLICATIONS

The present application matured from papers filed under the Invention Document Disclosure program, Document No. 363642.

BACKGROUND OF THE INVENTION

1. Field of the invention

The present invention relates to art tools and training devices and, more particularly, to a sight activated device which aids the artist in drawing, painting, sculpting or otherwise rendering a three dimensional subject by maintaining a stationary three-dimensional perspective and allowing the user to accurately transpose that perspective from their field of view to their workpiece.

2. Description of the Background

Mists need to develop a consistent three-dimensional perspective on a subject/object in order to render an accurate two- or three-dimensional work. However, many aspiring artists lose or slightly shift their three-dimensional perspective in the middle of their work. For example, it is quite easy in the course of a 3–4 hour painting session to allow a slight visual shift forward, backward, or to the side. This is a mistake. Artists need to work on maintaining a constant perspective or absurd results can occur. For instance, a painting will show both the top and side of the subject's head, whereas only one of such views was truly visible from a given perspective.

The act of "framing" a subject provides a partial remedy. To accomplish this, an artist may erect a two-dimensional frame next to her easel through which the subject/object can be viewed. This helps to maintain perspective along the plane of the frame. The presence of the frame makes it easier for the artist to sense inadvertent shifts in perspective to the side. This is because the image as viewed through the frame more noticeably changes, whereas without the frame to provide a reference the, change would be unnoticeable. Unfortunately, the two-dimensional frame of reference provided by "flaming" helps only to eliminate gross shifts in perspective along the plane of the frame. Subtle or minor shifts to the side usually go unnoticed, and inadvertent zooming in or backing up remains completely unnoticeable. These actions inevitably result in inaccurate renditions.

It would be greatly advantageous to provide a device that maintains a constant three-dimensional perspective, and of equal importance, that conditions and teaches the user how to maintain a stationary three-dimensional perspective.

SUMMARY OF THE INVENTION

It is, therefore, an object of the present invention to provide a cost effective device to immediately alert a user to any shift in perspective, whether to the side, zooming in, or backing up, and no matter how subtle.

It is another object to provide a device for insuring that an artist maintains a constant three-dimensional perspective on an object or subject while rendering a work, and for helping said artist to capture an accurate three-dimensional image.

It is another object to provide a device that conditions and teaches the novice artist how to maintain a constant three-dimensional perspective, or reconditions the seasoned artist.

According to the present invention, the above-described and other objects are accomplished by providing a device for helping artists to maintain a constant three-dimensional perspective while rendering a subject or object. The drawing device includes a first visibly defined perimeter of a planar geometric figure having a first size, and a second visibly defined perimeter of a planar geometric fine having a larger overall size than the first planar figure. The geometric figures may be any two-dimensional figures such as squares, circles, triangles, ellipses, etc. The device includes means for securing the first and second planar geometric figures in a concentric spaced relation along the artist's line of sight, the smaller geometric figure being closer to the artist. The artist secures the device in position for viewing a subject or object therethrough such that the perimeter of the second geometric figure is eclipsed from sight by the perimeter of the first geometric figure. This fixes the artist's perspective on said subject/object in all of three dimensions, and any deviation from the fixed perspective becomes immediately apparent when the state of eclipse is lost. In an exemplary square embodiment the first and second planar geometric perimeters are both formed from a plurality of interlocking blocks and rods.

BRIEF DESCRIPTION OF THE DRAWINGS

Other objects, features, and advantages of the present invention will become more apparent from the following detailed description of preferred embodiments and certain modifications thereof when taken together with the accompanying drawings in which.

DETAILED DESCRIPTION OF THE PREFERRED EMBODIMENTS

Figure 1:
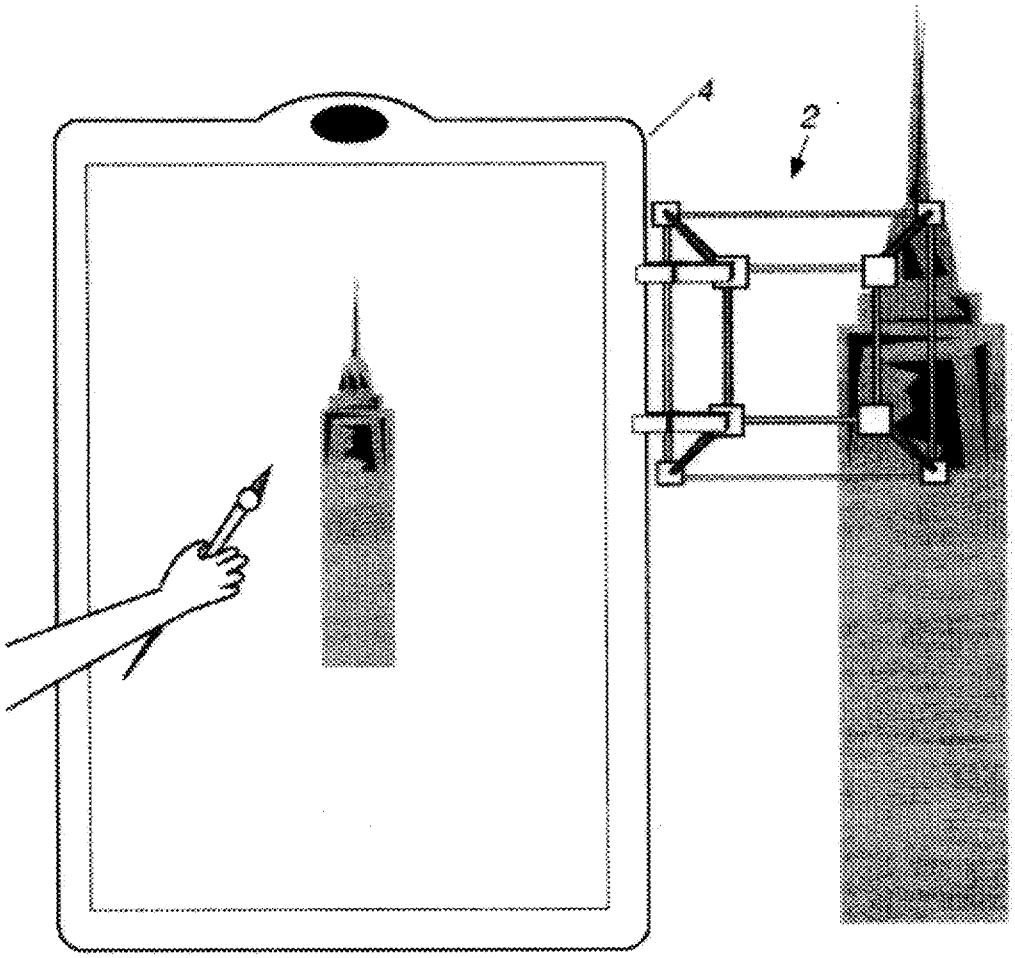
FIG. 1 is a perspective drawing showing the use of a stationary perspective device 2 in accordance with one embodiment of the present invention.

FIG. 1 shows an artist's perspective training device 2 in accordance with one embodiment of the present invention. The device is shown attached to an artist's easel 4 and is equipped with two attachment clips 20 for such purpose. In the illustrated embodiment, attachment clips 20 are conventional clothespins, but any other suitable attachment devices may be employed.

The device 2 helps to maintain a constant three-dimensional perspective. Over time, the use of device 2 conditions and teaches the user how to maintain a constant three-dimensional perspective. For novices the ability to maintain a constant perspective becomes ingrained, and the artist becomes capable of holding her perspective without further assistance of the device 2. Seasoned artists receive reconditioning sufficient to revive their ability to maintain a constant perspective.

Figure 2:
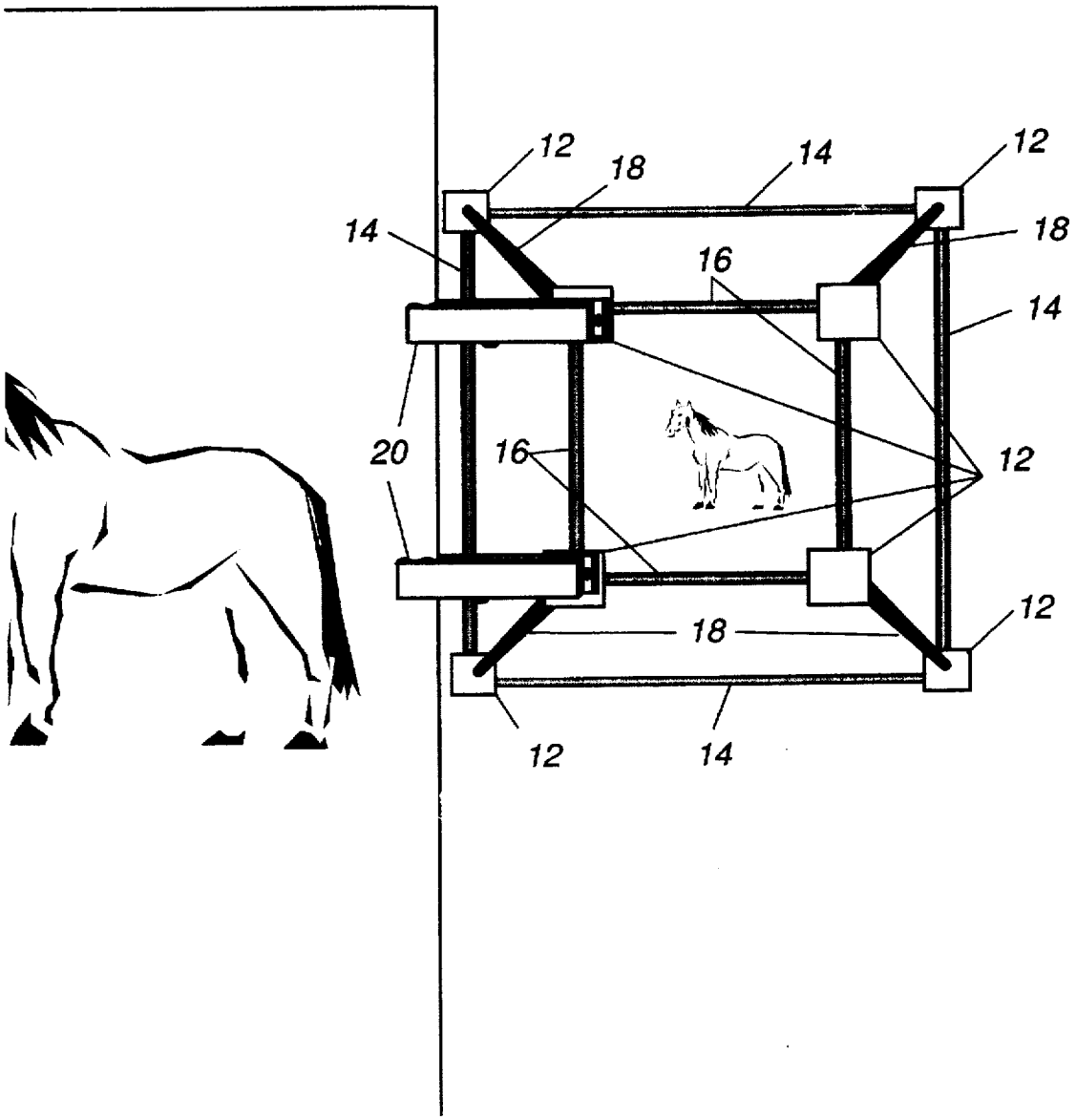
FIG. 2 is an enlarged view of the stationary perspective device 2 of FIG. 1.

FIG. 2 is an enlarged view of the stationary perspective device 2 of FIG. 1. The device 2 is generally constructed by securing two (2) visibly defined perimeters of planar geometric figures having different sizes. The larger and smaller visibly defined perimeters are secured in a concentric relation along the artist's line of sight. In the illustrated embodiment, the device 2 is accomplished with the perimeters of two concentric squares. However, the chosen geometric perimeter may alternatively be rectangular, circular, triangular, elliptical, or any other two-dimensional geometric figure as desired.

The two concentric squares of the illustrated stationary perspective device 2 are each formed from four blocks 12 and four connecting rods 14, 16. The two concentric squares are held in their concentric yet spaced relation by four additional connecting rods 18. The square having the smaller perimeter is held forwardly (closer to the artist) of the square having the larger perimeter. It is helpful to set the device 2 on a tripod or clip it to the easel 4 (or drawing board) in order to keep it stationary. The device 2 may be affixed to an artist's easel by any suitable fastening means and two conventional clothespins 20 are presently preferred.

In operation, the device 2 is arranged so that the artist may sight or view her subject/object through the perimeters of both spaced geometric figures (squares), with the smaller of the two perimeters between the artist (sighting source) and the larger of the two perimeters, while keeping the device 2 at such a distance so that the larger perimeter is eclipsed from sight by the smaller perimeter. Use of the device 2 fixes the artist's perspective on his/her subject in all three dimensions. Any deviation from the fixed perspective becomes manifestly apparent thanks to the device 2 because the smaller perimeter will appear to move out of position and no longer eclipse the larger perimeter.

Figure 3A:
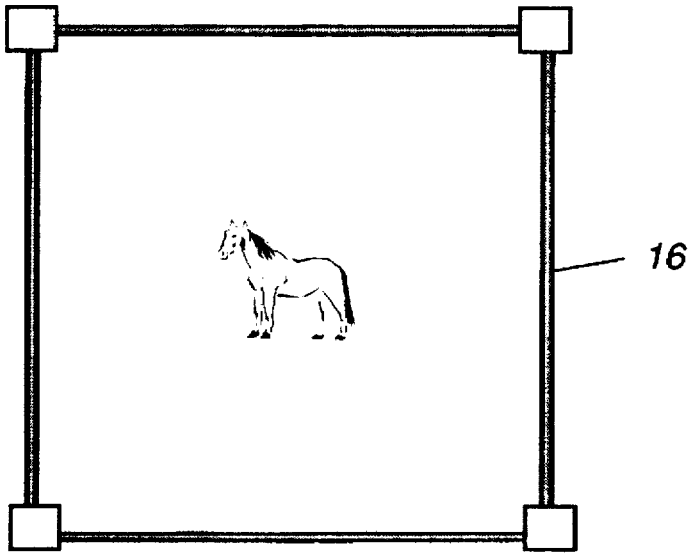
FIGS. 3*a–c* are enlarged views illustrating the use of the stationary perspective device 2 of FIGS. 1 and 2.
Figure 3B:
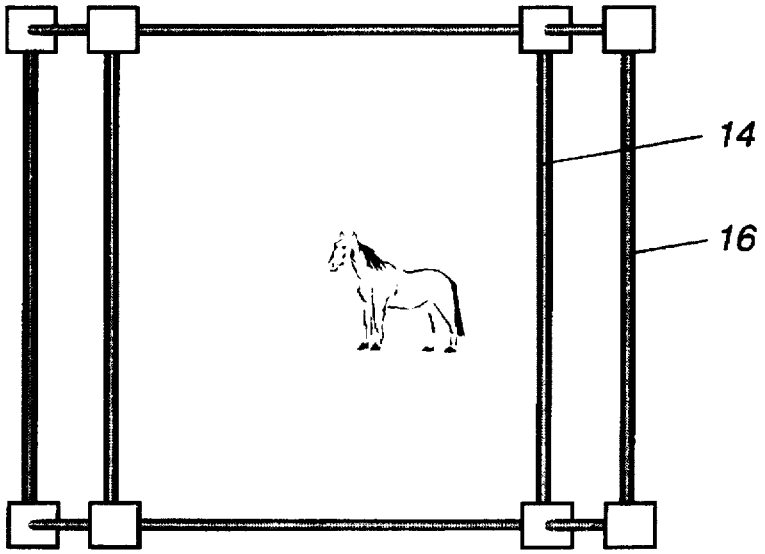
Figure 3C:
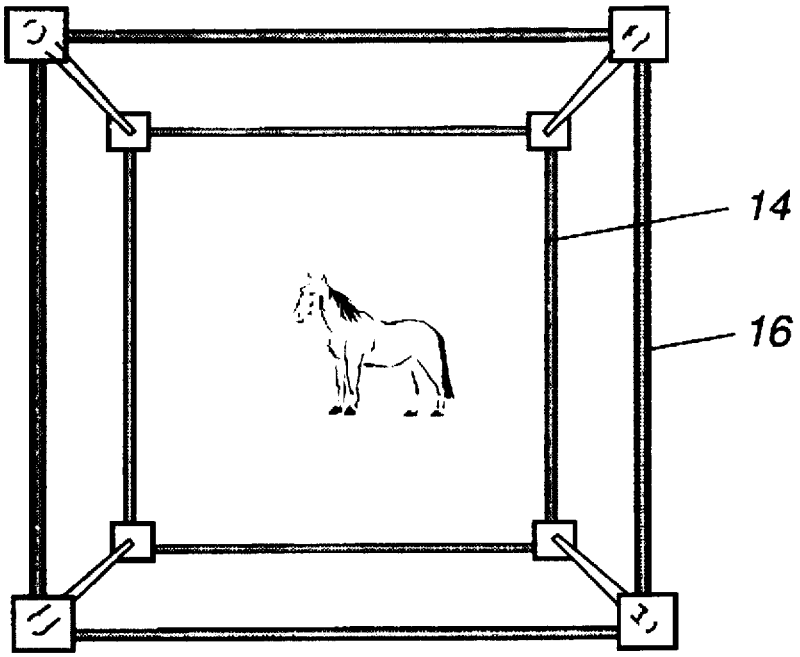

The visual operation of the device is shown in FIGS. 3*a–c*.

FIG. 3*a* illustrates the proper three-dimensional perspective with the smaller perimeter in proper position and completely eclipsing the larger perimeter.

FIG. 3*b* illustrates an improper perspective which has been shifted to the right, the smaller perimeter being wayward left and not eclipsing the larger perimeter. For an improper perspective which has been shifted to the left, the smaller perimeter becomes wayward right and fails to eclipse the larger perimeter.

FIG. 3*c* illustrates an improper perspective which has been zoomed in too far toward the subject. The smaller perimeter appears unduly enlarged and outside the larger perimeter (and not eclipsing the larger perimeter). Similarly, for an improper perspective which has been shifted backward, the smaller perimeter appears unduly small and inside the larger perimeter (and not eclipsing the larger perimeter).

The device 2 can be consulted every time the user needs to find the original three-dimensional perspective. It can be seen how the presence of the three-dimensional frame of reference makes it easier for the artists to sense when their perspective has inadvertently shifted forward, backward, up, down, or to either side. This is because the image as viewed through the frame noticeably changes, whereas without the frame to provide a reference the change would be unnoticeable. Thanks to the three-dimensional operation of the device, inadvertent zooming in or backing up becomes noticeable since the smaller perimeter will then appear inside or outside (but not fully eclipsing) the larger perimeter. Consequently, the artist can easily render an accurate picture.

It should be noted that it is not necessary to limit the object/subject to the view encompassed therein. Objects visible outside the frame of the device 2 can be part of the intended subject matter, and the artist's perspective on these objects is likewise marked.

Figure 4:
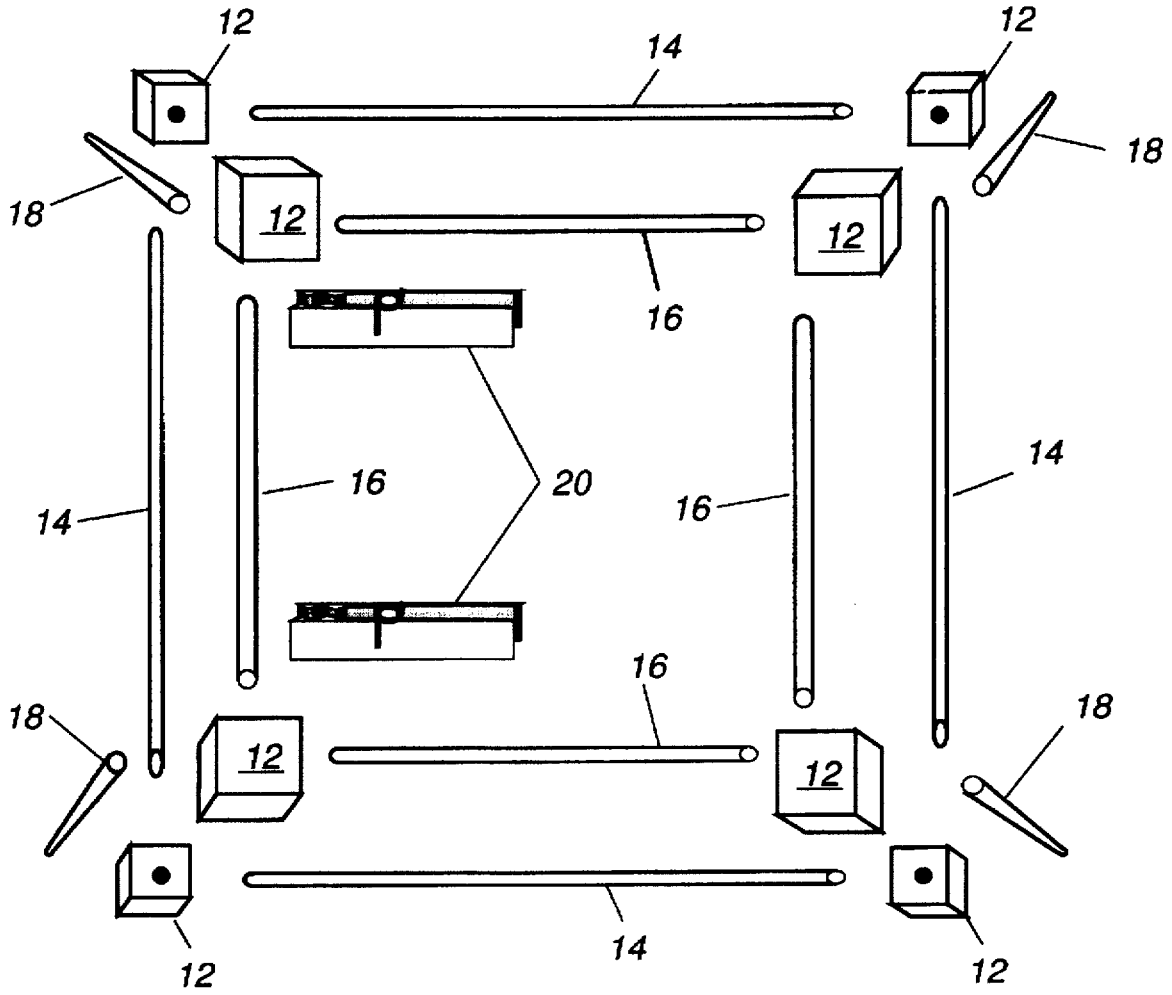
FIG. 4 is an exploded diagram of a stationary perspective device 2 of FIGS. 1 and 2.

FIG. 4 illustrates an assembly diagram of a square embodiment of an artists's stationary perspective device in accordance with FIGS. 1–3. The smaller perimeter square is constructed of four connecting rods 16 and four blocks 12 each having three bore-holes entering adjacent sides for insertion of connecting rods. Likewise, the larger perimeter square is constructed of four connecting rods 14 and four blocks 12 each having three bore-holes entering adjacent sides for insertion of connecting rods. The larger perimeter square is attached to the smaller perimeter square by four lateral connecting rods 18. Two conventional clothespins 20 may be glued, screwed or otherwise fastened to the connecting rods 14, 16 or 18 in order to secure the device 2 to an easel, sketch pad or the like. Conventional wood screws may be used for this purpose, but in this case it is suggested that an amount of glue also be used to prevent rotation of the clothespins 20. Blocks 12 may be formed, for example, from a ¾"×¾"×¾" square of wood, aluminum, brass, plastic or other suitable material. Of course, the size of blocks 12 may vary to an extent, but it has been found that below ⅝" may result in instability, whereas over 1" become visually obtrusive. Likewise, rods 14, 16 and 18 may be formed of the same materials or combinations thereof. An appropriate length for rods 16 is approximately 5¾" long (to yield a 6¼" measurement from the outer comers of the blocks 12). In this case, rods 14 may be 7¾" (to yield a 8¼" measurement from the outer comers of the blocks 12). The four lateral connecting rods 18 should then be approximately 6⅞" long (to yield a 7⅜" measurement from the outer comers of the blocks 12). Of course, these dimensions may vary depending on the desired overall size of the perspective device.

The bore-holes in blocks 12 preferably extend into the blocks by the minimum length needed to securely anchor rods 14, 16 and 18 therein, e.g., approximately ¼". A frictional engagement of rods 14, 16, 18 in blocks 12 is sufficient and allows device 2 to be conveniently disassembled for travel or storage. However, glue may be used to provide a more permanent assembly.

Figure 5:
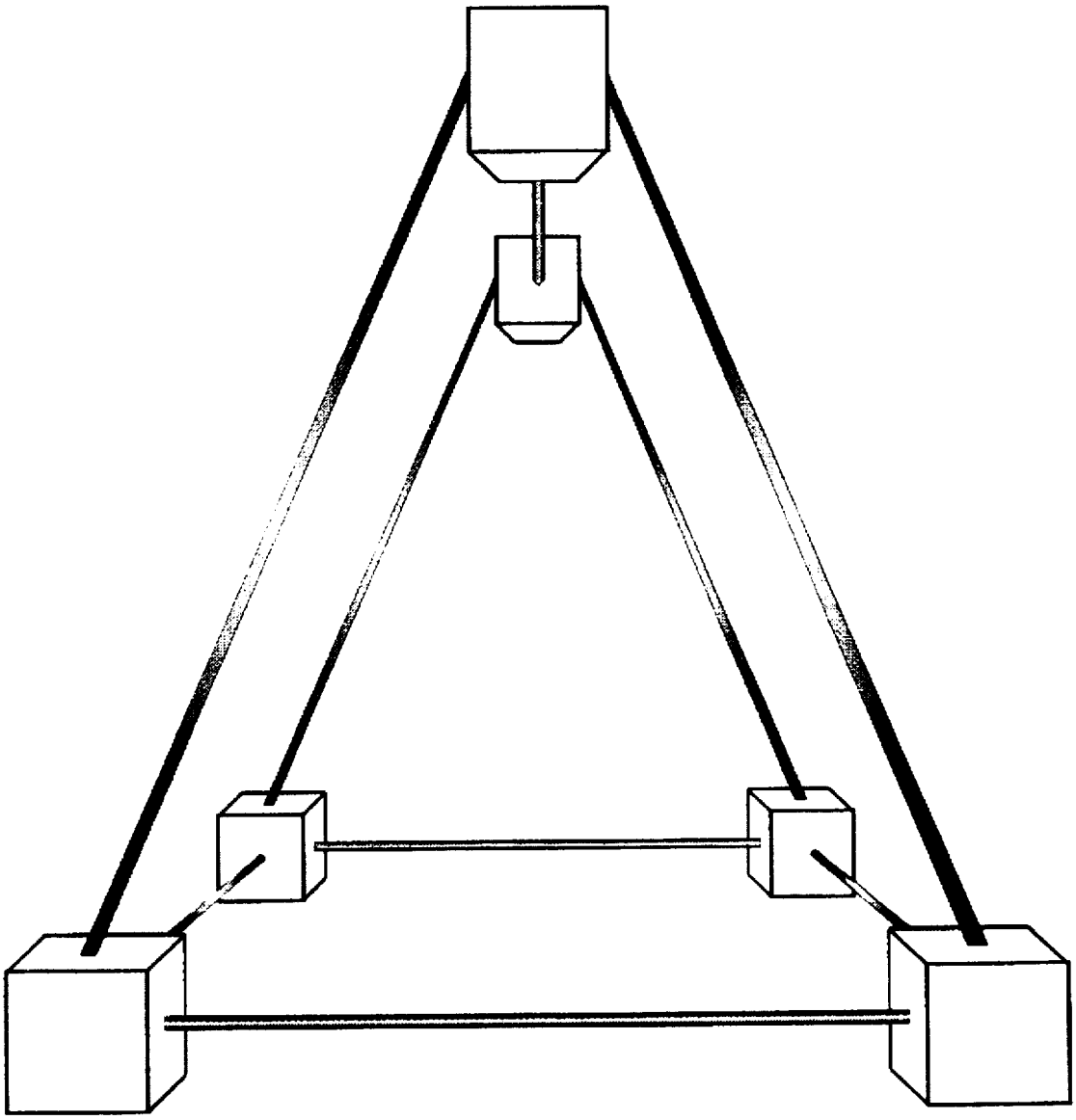
FIG. 5 is a perspective drawing showing the use of a stationary perspective device in accordance with a second embodiment of the present invention.

FIG. 5 shows an alternate embodiment of the stationary perspective device in which the selected geometric perimeter is in a triangular configuration. The perspective device is assembled in much the same fashion as explained above for a square configuration, except that the bore-holes in each block are angled to impart the triangular configuration.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. For example, the stationary perspective device 2 may be constructed of plastic and have molded perimeters made visible by paint or the like. It is to be understood, therefore, that within the scope of the appended claims, the invention may be practiced otherwise than as specifically set forth herein.

We claim:

1. A stationary perspective device for assisting in maintaining a constant three-dimensional perspective while rendering a subject or object, comprising:

a first visually-defined perimeter of a planar geometric figure having a first size;

a second visually-defined perimeter of a planar geometric figure having a larger size than said first planar perimeter;

means for securing the first and second planar perimeters in a concentric spaced relation along the artist's line of sight, the smaller geometric perimeter being closer to the artist;

wherein the device is secured in a position for viewing a subject or object therethrough such that the perimeter of said second geometric figure is eclipsed from sight by the perimeter of the first geometric figure, thereby fixing the artist's perspective on said subject/object in all of three dimensions and any deviation from said fixed perspective becomes apparent.

2. The stationary perspective device according to claim 1, wherein said first and second visually defined perimeters conform to one of a square, rectangle, circle, triangle, and ellipse.

3. The stationary perspective device according to claim 1, wherein said first and second planar geometric perimeters are secured together and held at a spaced relation by lateral supports.

4. The stationary perspective device according to claim 1, further comprising attachment means for securing said device in a position for viewing a subject or object therethrough.

5. The stationary perspective device according to claim 1, wherein said attachment means further comprise a pair of clips for removably clipping said device to an easel or the like.

6. A stationary perspective device for assisting in maintaining a constant three-dimensional perspective while rendering a subject or object, comprising:

a first visually-defined perimeter of a planar geometric figure formed from a plurality of interlocking blocks and rods, said perimeter having a first size;

a second visually-defined perimeter of a planar geometric figure formed from a plurality of interlocking blocks and rods, said perimeter having a second larger size than said first planar perimeter;

means for securing the first and second planar perimeters in a concentric spaced relation along the artist's line of sight, the smaller geometric perimeter being closer to the artist;

wherein the device is secured in a position for viewing a subject or object therethrough such that the perimeter of said second geometric figure is eclipsed from sight by the perimeter of the first geometric figure, thereby fixing the artist's perspective on said subject/object in all of three dimensions and any deviation from said fixed perspective becomes apparent.

7. The stationary perspective device according to claim 6, wherein said first and second planar geometric perimeters are secured together and held at a spaced relation by lateral interlocking rods.

8. The stationary perspective device according to claim 7, wherein said first visually-defined perimeter comprises four blocks having central bore-holes entering three sides, and four interlocking rods fit into the bore-holes of said blocks to form a square.

9. The stationary perspective device according to claim 8, wherein said second visually-defined perimeter comprises four blocks having central bore-holes entering three sides, and four interlocking rods fit into the bore-holes of said blocks to form a square.

10. The stationary perspective device according to claim 9, wherein said first and second planar geometric perimeters are secured together and held at a spaced relation by four lateral interlocking rods inserted into said blocks.

11. The stationary perspective device according to claim 7, wherein said first visually-defined perimeter comprises three blocks having central bore-holes entering three sides, and three interlocking rods fit into the bore-holes of said blocks to form a triangle.

12. The stationary perspective device according to claim 11, wherein said second visually-defined perimeter comprises three blocks having central bore-holes entering three sides, and three interlocking rods fit into the bore-holes of said blocks to form a triangle.

13. The stationary perspective device according to claim 12, wherein said first and second planar geometric perimeters are secured together and held at a spaced relation by three lateral interlocking rods inserted into said blocks.

14. The stationary perspective device according to claim 13, wherein said first and second planar geometric perimeters lie along parallel planes.

* * * * *